US011001054B2

(12) United States Patent
Noterman

(10) Patent No.: US 11,001,054 B2
(45) Date of Patent: May 11, 2021

(54) METAL PHOTOGRAPHIC PLATE WITH CARRIER AND METHOD OF USE

(71) Applicant: Christian Carter Noterman, Westminster, CA (US)

(72) Inventor: Christian Carter Noterman, Westminster, CA (US)

( * ) Notice: Subject to any disclaimer, the term of this patent is extended or adjusted under 35 U.S.C. 154(b) by 114 days.

(21) Appl. No.: 16/594,459

(22) Filed: Oct. 7, 2019

(65) Prior Publication Data

US 2021/0101383 A1 Apr. 8, 2021

(51) Int. Cl.
*B41J 2/005* (2006.01)

(52) U.S. Cl.
CPC ..... *B41J 2/0057* (2013.01)

(58) Field of Classification Search
CPC ..... B41J 2/0057; B41J 2/325; B41J 3/413
See application file for complete search history.

(56) References Cited

U.S. PATENT DOCUMENTS 4,515,838 A * 5/1985 Miyajima ..... A47G 1/143 229/92.8
2012/0007914 A1* 1/2012 Eboshi ..... B41M 5/0017 347/21
2015/0287874 A1* 10/2015 Lin ..... H01L 31/022433 239/548

* cited by examiner

*Primary Examiner* — Scott A Richmond
(74) *Attorney, Agent, or Firm* — Eric Hanscom

(57) ABSTRACT

This disclosure provides a printing template for use during an aqueous inkjet printing process in which ink is transferred onto a metal panel. The printing template includes a printable film having die cut area inside perimeter edge of its first layer, a generally flat metal panel having the same size as to that of the die cut area in the printable film, and a carrier having a recess which is sized and configured to encompass the shaped perimeter of the metal panel. The metal panel is secure within the die cut area and the recess in such a way that it is sandwiched between the printable film and the carrier during the printing process.

20 Claims, 14 Drawing Sheets

METAL PHOTOGRAPHIC PLATE WITH CARRIER AND METHOD OF USE

CROSS-REFERENCES TO RELATED APPLICATIONS

The present application is a continuation-in-part of a U.S. Non-Provisional patent application Ser. No. 16/008,741, filed Jun. 14, 2018, claiming priority under 35 U.S.C. § 119(e) to U.S. Provisional Patent Application No. 62/520,955, filed Jun. 16, 2017, the entire contents of which are incorporated by reference as if set forth fully herein.

TECHNICAL FIELD

The present disclosure relates generally to the field of printing, and more specifically to printing photographs on metal substrates.

BACKGROUND

Printing photos on metal is not a new technique of creating attractive photographs. The prior art provides several methods of ways of printing on metal using latex or UV printers/inks. The prior art also discloses the use of sublimation inks, which are used to initially print on a transfer material, then using a heat press, sublimate or transfer the image from the transfer material onto a piece of metal (normally aluminum) that has been coated to receive these sublimation/heat transfer inks. There is also prior art on creating metal plates with printing on them, where the metal plate has to be covered with some sort of clear plastic coating to seal in the ink.

While these methods are effective in transferring an image onto metal, many aqueous inkjet printers "read" the edges of the metal plate and print up to the edge—rather than over the edge—leaving an undesired "margin" around the edge of the metal plate. These printers do not offer the "edge to edge" printing capabilities that result in top quality, attractive finished products. This is particularly true when printing on metal and other rigid substrates, but even when printing on non-rigid substrates, these printers do not produce truly "edge to edge" finished products. The requirement that the metal picture be covered with a plastic sheet to seal in the ink is also cumbersome and requires a person to make sure there are no bubbles under the plastic covering. Thus, there is a long-felt need for a product that can produce a borderless metal picture without the need for additional covering, and a method by which it can be made. This class of printer is often found at retail locations that will print pictures for the customer on demand.

SUMMARY

The current disclosure provides a solution to this problem by describing a printing template for use during an aqueous inkjet printing process in which ink is transferred onto a metal panel. Another key inventive step to this invention is the ability to print indirectly onto a metal panel without the need to place any layer of material over the finished product. That is, firstly, an image is printed on a printable surface of a printable film or a clear film. The printable surface is defined within a die cut area of a front face of the printable film. The die cut area allows a printed image to fill the entirety of the printable surface in the die cut area and extends on to at least a portion (beyond the die cut area) of the first layer of the printable film.

Then, the metal panel is placed inside a recess of a carrier (alignment jig), with an adhesive side up. The carrier also has a square or rectangular shape that has been pre-cut into the carrier so that it can be easily removed, for example such that a hanger can be attached to the metal panel through the carrier.

In an example, the adhesive side of the metal panel may be covered with a protective film. This protective film, if provided, has to be removed after placement of the metal panel inside the recess of the carrier (alignment jig).

Thereafter, the printable film is placed, image printed side down on the carrier (alignment jig) over the top of the metal panel. That is, the printed side of the printable film faces the adhesive side of the metal panel, while sandwiching the metal panel in between the printable film and the carrier.

Also, the printable film may include aligning holes to align itself with the registration/alignment pins on the carrier so that the carrier locks and entirely covers the printable film. This "sandwich" is then fed through heated rollers of a lamination device to activate the thermal adhesive coated on the metal panel, thereby bonding the printed film to the surface of the metal panel. After this lamination process of the lamination device, the excess printable film is removed and discarded, leaving a printed image on the metal panel. This image is protected by the printable film it was printed on, as that printable film now acts as a protective laminate.

Also, the carrier a non-stick coating around the recess (holding the metal panel) to prevent printing to the surface of the carrier during transportation/printing of the image to the metal panel.

Thus, the problem of how to create borderless metal prints is solved by providing a carrier upon which the metal panel is removably attached.

It is a principal object of the disclosure to provide a means by which a metal panel can have a picture printed on it by a standard industry inkjet printer using standard industry ink, without a border or margin.

A further object of the disclosure is to provide a metal panel with a special coating that will allow ink from an inject printer to effectively adhere to the metal plate without problems of running.

A further object of the disclosure is to provide a final product metal panel where there is no need for any additional plastic coverings or coatings to seal in the ink.

It is another object of the disclosure to provide a metal panel that is removably attached to a carrier, where the carrier has a width and a length that is greater than the width and length of the metal plate, such that the metal panel can be removably affixed to the carrier such that all the edges of the metal panel are surrounded by the carrier.

An additional object of the disclosure calls for the metal panel to be easily removable from the carrier and where the carrier can be disposed of easily.

Another object of the disclosure is to provide, optionally, for the carrier to be reusable with additional metal panel.

Another object of the disclosure is to provide and easy means by which the metal panel can be hung.

Another object of the disclosure is to provide an alignment jig as a carrier to encompass the metal panel along with the printable film during the lamination process.

There has thus been outlined, rather broadly, the more important features of the metal photographic plate and carrier in order that the detailed description thereof may be better understood, and in order that the present contribution to the art may be better appreciated. There are additional features that will be described hereinafter and which will form the subject matter of the claims appended hereto. The features listed herein and other features, aspects and advantages of the present disclosure will become better understood with reference to the following description and appended claims.

BRIEF DESCRIPTION OF THE DRAWINGS

Many advantages of the present disclosure will be apparent to those skilled in the art with a reading of this specification in conjunction with the attached drawings, wherein like reference numerals are applied to like elements and wherein.

DETAILED DESCRIPTION OF A PREFERRED EMBODIMENT

Figure 1:
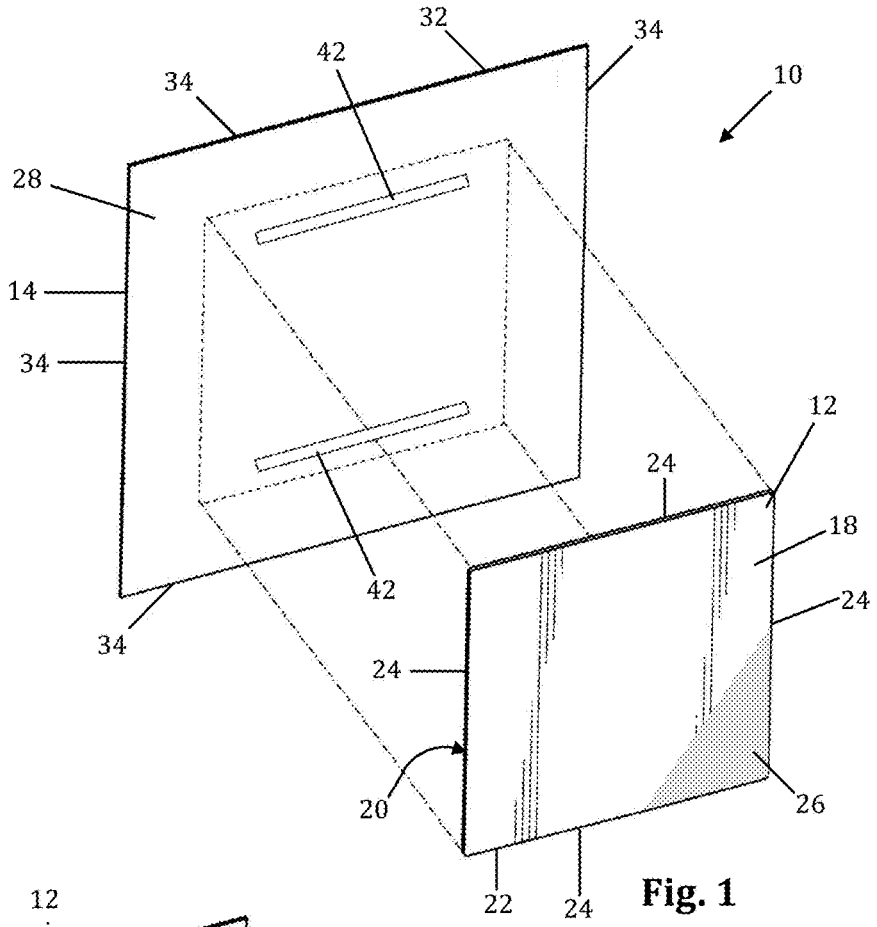
FIG. 1 is a perspective view of an example of a printable metal plate in alignment for association with an example of a metal plate carrier, according to one embodiment of the disclosure.

Illustrative embodiments of the disclosure are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. The metal photographic plate with carrier and related methods disclosed herein boasts a variety of inventive features and components that warrant patent protection, both individually and in combination.

FIGS. 1-5 illustrate a first example of a printing template 10 for use in aqueous inkjet printing onto a metal substrate, according to one embodiment of the disclosure. By way of example only, the printing template 10 of the instant embodiment includes a printable metal plate 12, a carrier 14, and a hanging element 16. The printable metal plate 12 has front face 18, a back face 20, and a perimeter 22. In the example shown in FIGS. 1-5, the printable metal plate 12 has a generally rectangular shape having four opposing edges 24, however it should be understood that the metal plate 12 may have any shape (e.g. circular, oval, triangular, etc.) without departing from the scope of the disclosure. Preferably, the metal plate 12 is made of aluminum, however other any other suitable metal may be used.

The front face 18 is completely covered by a printable film layer 26, and defines the printable surface of the metal plate 12. The printable film layer 26 may be any material that is capable of accepting aqueous inkjet ink, including but not limited to (and by way of example only) polyester, polyethylene, Mylar, vinyl, PVC, PET, BOTT, polypropylene, polycorbonate, and acrylics. The key to the selection of the film is that it can accept and retain the aqueous ink from an inkjet printer. According to a preferred embodiment, an inkjet ink-retaining microporous coating may be applied on top of the printable film layer 26 to enhance the ink retention properties of the printable film layer 26. The coating technique can be accomplished (by way of example) with slot die, curtain, gravure or Mayer rod techniques. It should be noted, however, that the key characteristics of the printable film layer 26 include, but are not limited to, ink adhesion and retention properties, cost, and optical clarity. With the use of this specialized printable film 26, there is no need for any "final" covering sheet or other process to seal in the ink after the metal print leaves the printer.

The carrier 14 has front face 28, a back face 30, and a perimeter 32. The carrier 14 is sized and configured such that carrier 14 is larger than the metal plate 12, and more specifically such that the entire perimeter 32 of the carrier 14 is outside of the entire perimeter 22 of the metal plate 12 when the metal plate 12 is associated with the carrier 14. The respective perimeter shapes of the metal plate 12 and carrier 14 do not have to match. In the example shown in FIGS. 1-5, the carrier 14 has a generally rectangular shape having four opposing edges 34. Although the generally rectangular shape is preferable since the carrier 14 interacts with the printer and therefore consistency of size and shape is advantageous, nevertheless it should be understood that the carrier 14 may have any perimeter shape (e.g. circular, oval, triangular, etc.) without departing from the scope of the disclosure, so long as the entire perimeter 32 of the carrier is 14 is outside of the entire perimeter 22 of the metal plate 12. That is because a portion of the front face 28 (e.g. the portion of the front face 28 that is immediately adjacent the perimeter 22 of the metal plate 12) represents a "print zone" 36 that receives ink from the ink dispensing element of the printer when the ink dispensing element traverses beyond the perimeter 22 of the metal plate 12 during the printing process.

Figure 4:
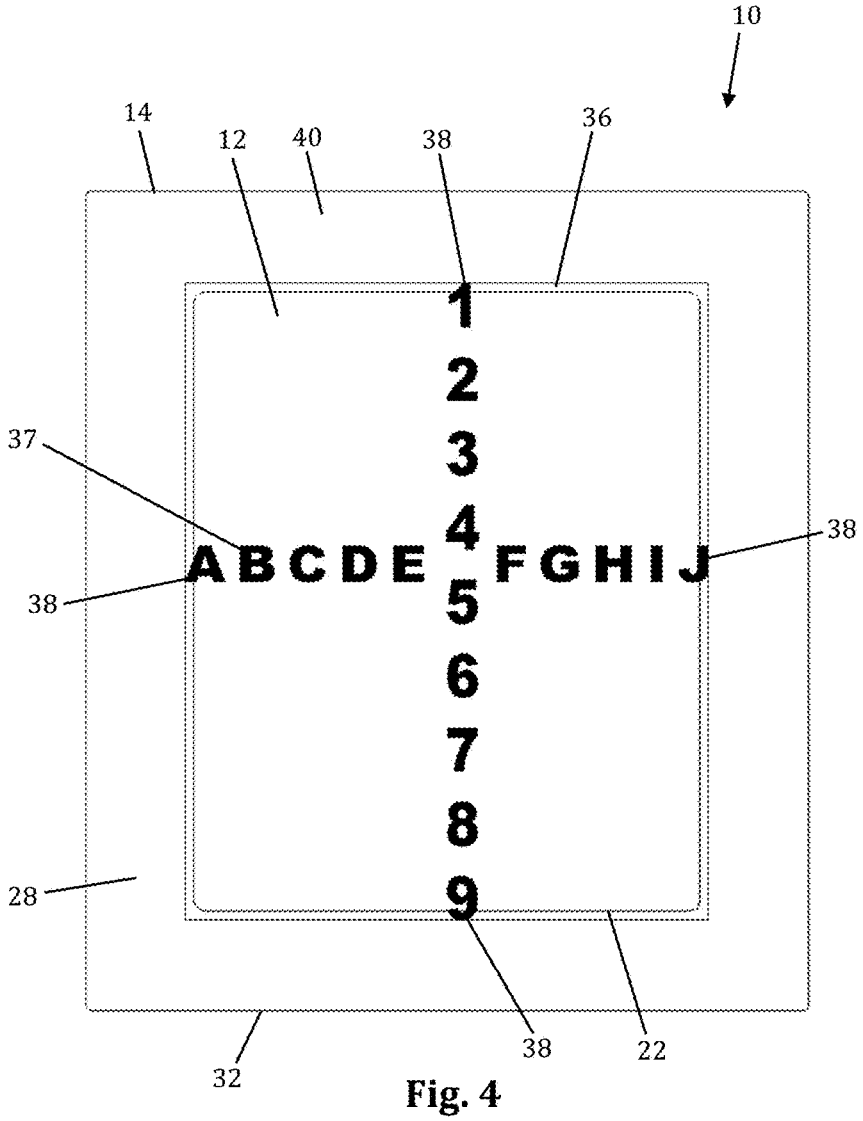
FIG. 4 is a plan view of the metal plate and carrier of FIG. 3 after printing has occurred.
Figure 5:
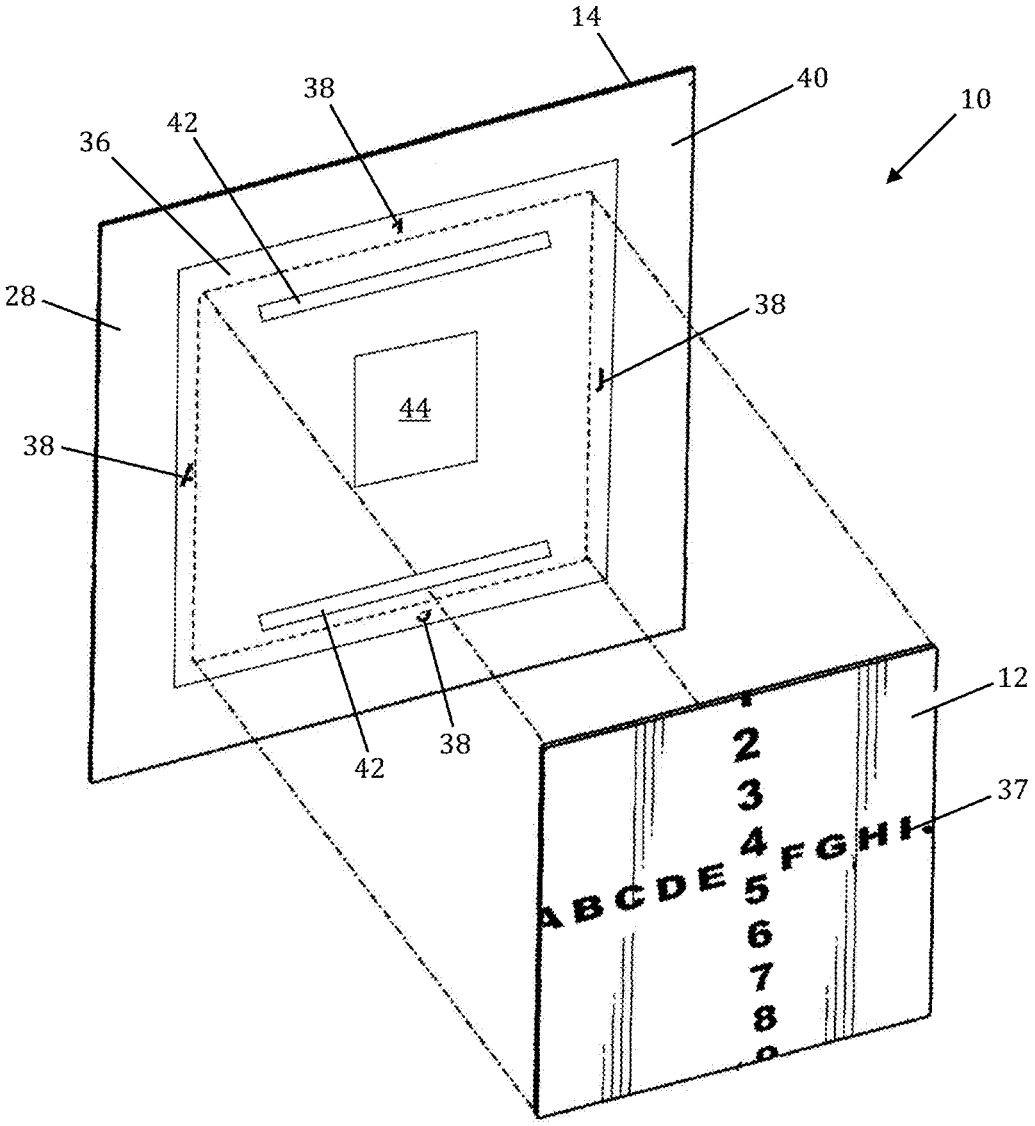
FIG. 5 is a perspective view of the post-printing metal plate and carrier of FIG. 4, particularly illustrating the metal plate being removed from the carrier and showing how the printer is "tricked" by the carrier into printing over the edges of the metal plate onto a portion of the carrier, thereby avoiding an unprinted margin or border on the metal plate.

The front face 28 of the carrier 14 has an external coat that mimics the printable film layer 26 of the metal plate 12 such that the printer prints over the edges 24 of the metal plate 12 onto the carrier 14. This results in the metal plate 12 having printing 37 over its entire front face 18, and then leaving a narrow strip of overlap printing 38 in the print zone 36 of the carrier 14 that surrounds the edges 24 of the metal plate 12, while leaving an unprinted section 40 of the carrier 14 that was not printed upon, as shown in FIGS. 4-5.

Figure 3:
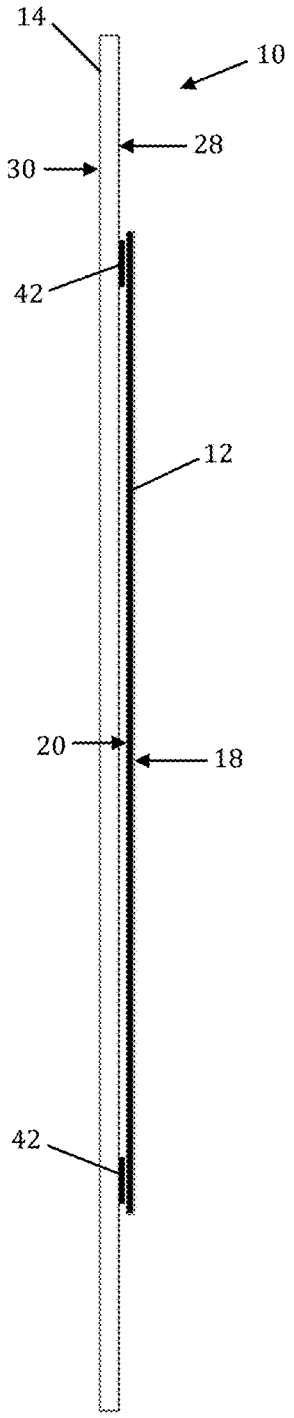
FIG. 3 is a side plan view of the printable metal plate of FIG. 1 associated with the carrier of FIG. 1.

The carrier 14 further includes at least one metal plate engaging element 42 configured to engage the metal plate 12 and maintain the association of the metal plate 12 and carrier 14 through the printing process. By way of example, the plate engaging element 42 of the instant embodiment comprises adhesive strips that secure the metal plate 12 to the front surface 28 of the carrier 14 during the printing process, as shown in FIGS. 1 and 3. The adhesive strips 42 allow for removal of the metal plate 12 from the carrier 14 by exerting sufficient force on the metal plate 12 to overpower the adhesive strip.

The back face 30 of the carrier 14 includes at least one perforated section that is removable to create a cutout opening 44 through which the hanging element 16 may be attached to the back face 20 of the metal plate 12 prior to disassociating the metal plate 12 and carrier 14. By way of example, the cutout opening 44 is shown as having a generally rectangular (or square) shape, however any shape is possible that allows passage of the hanging element 16 therethrough. The back face 20 of the metal plate 12 includes a leveling indicia 46 that serves as an alignment guide for placing the hanging element 16 on the back of the metal plate 12 as the hanging element 16 is inserted into the cutout opening 44 of the carrier 14.

Figure 2:
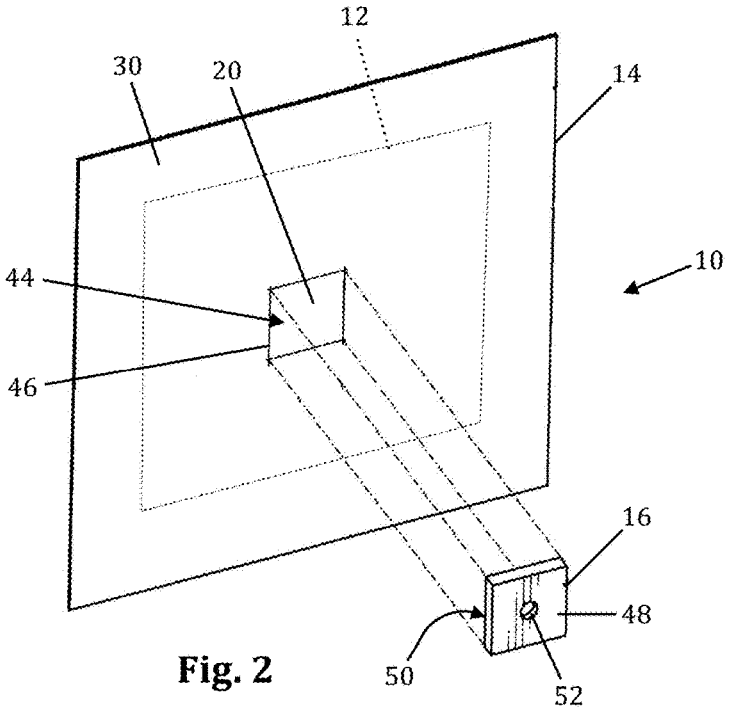
FIG. 2 is a perspective view of the back of the carrier of FIG. 1 with an example of a hanging element in alignment with a leveling indicia on the back of the carrier enabling a user to attach the hanging element to the back of the metal plate of FIG. 1 through a hole in the carrier.

The hanging element 16 of the present disclosure may be any attachable element or object that enables a user to hang the metal plate 12 on a wall. By way of example only, the hanging element 16 shown in FIG. 2 is a generally rectangular (or square) piece of material (e.g. metal) having a front side 48 and a back side 50. The back side 50 includes an adhesive layer (not shown) that enables the hanging element 16 to be attached to the back face 20 of the metal plate 12 through the cutout opening 44 in the carrier 14. The hanging element 16 further includes a through-hole 52 (for example) sized and configured to receive at least a portion of a wall-mounted hanging element (not shown) so that the printed metal plate 12 may be displayed on a wall (see e.g. FIG. 18).

FIGS. 6-11 illustrate a second example of a printing template 110 for use in aqueous inkjet printing onto a metal substrate, according to one embodiment of the disclosure. By way of example only, the printing template 110 of the instant embodiment includes a printable metal plate 112, a carrier 114, and a hanging element (not shown). The printable metal plate 112 has front face 118, a back face 120, and a perimeter 122. In the example shown in FIGS. 6-11, the printable metal plate 112 has a generally rectangular shape having four opposing edges 124, however it should be understood that the metal plate 112 may have any shape (e.g. circular, oval, triangular, etc.) without departing from the scope of the disclosure. Preferably, the metal plate 112 is made of aluminum, however other any other suitable metal may be used.

The front face 118 is completely covered by a printable film layer 126, and defines the printable surface of the metal plate 112. The printable film layer 126 may be any material that is capable of accepting aqueous inkjet ink, including but not limited to (and by way of example only) polyester, polyethylene, Mylar, vinyl, PVC, PET, BOTT, polypropylene, polycorbonate, and acrylics. The key to the selection of the film is that it can accept and retain the aqueous ink from an inkjet printer. According to a preferred embodiment, an inkjet ink-retaining microporous coating may be applied on top of the printable film layer 126 to enhance the ink retention properties of the printable film layer 126. The coating technique can be accomplished (by way of example) with slot die, curtain, gravure or Mayer rod techniques. It should be noted, however, that the key characteristics of the printable film layer 126 include, but are not limited to, ink adhesion and retention properties, cost, and optical clarity. With the use of this specialized printable film 126, there is no need for any "final" covering sheet or other process to seal in the ink after the metal print leaves the printer.

The carrier 114 has front face 128, a back face 130, and a perimeter 132. The carrier 114 is sized and configured such that carrier 114 is larger than the metal plate 112, and more specifically such that the entire perimeter 132 of the carrier 114 is outside of the entire perimeter 122 of the metal plate 112 when the metal plate 112 is associated with the carrier 114. The respective perimeter shapes of the metal plate 112 and carrier 114 do not have to match. In the example shown in FIGS. 6-11, the carrier 114 has a generally rectangular shape having four opposing edges 134. Although the generally rectangular shape is preferable since the carrier 114 interacts with the printer and therefore consistency of size and shape is advantageous, nevertheless it should be understood that the carrier 114 may have any perimeter shape (e.g. circular, oval, triangular, etc.) without departing from the scope of the disclosure, so long as the entire perimeter 132 of the carrier is 114 is outside of the entire perimeter 122 of the metal plate 112. That is because a portion of the front face 128 (e.g. the portion of the front face 128 that is immediately adjacent the perimeter 122 of the metal plate 112) represents a "print zone" 136 that receives ink from the ink dispensing element of the printer when the ink dispensing element traverses beyond the perimeter 122 of the metal plate 112 during the printing process.

Figure 10:
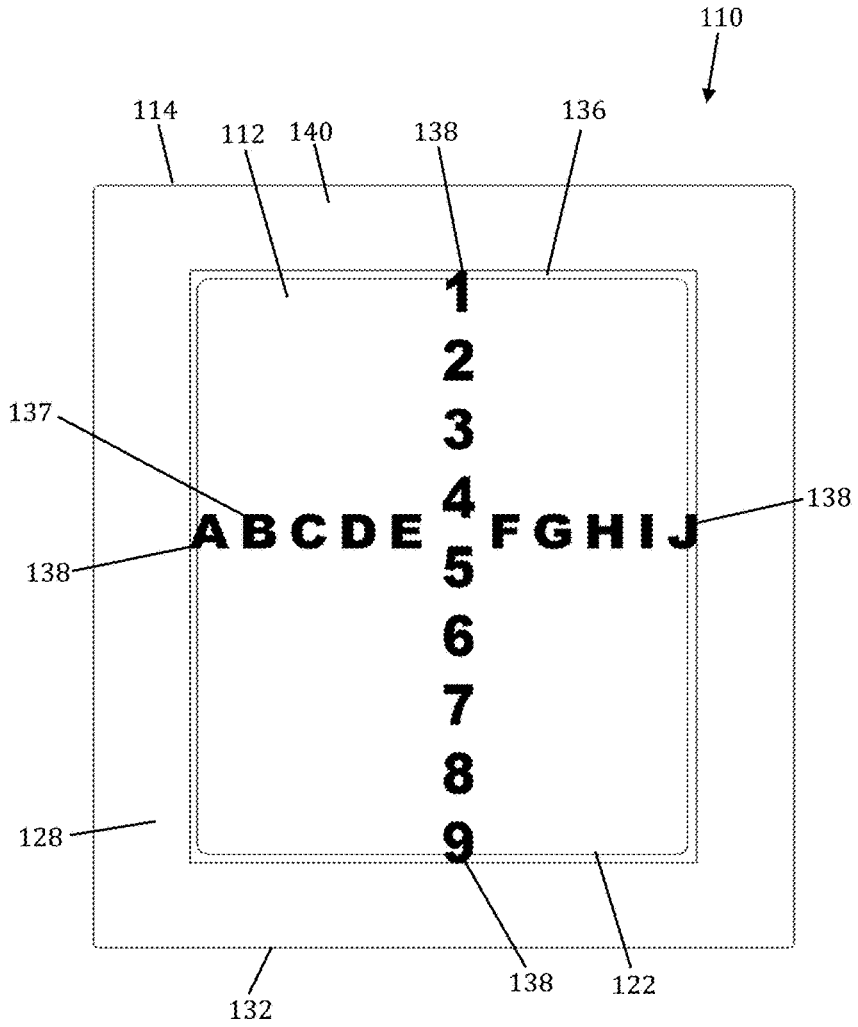
FIG. 10 is a plan view of the metal plate and carrier of FIG. 9 after printing has occurred.
Figure 11:
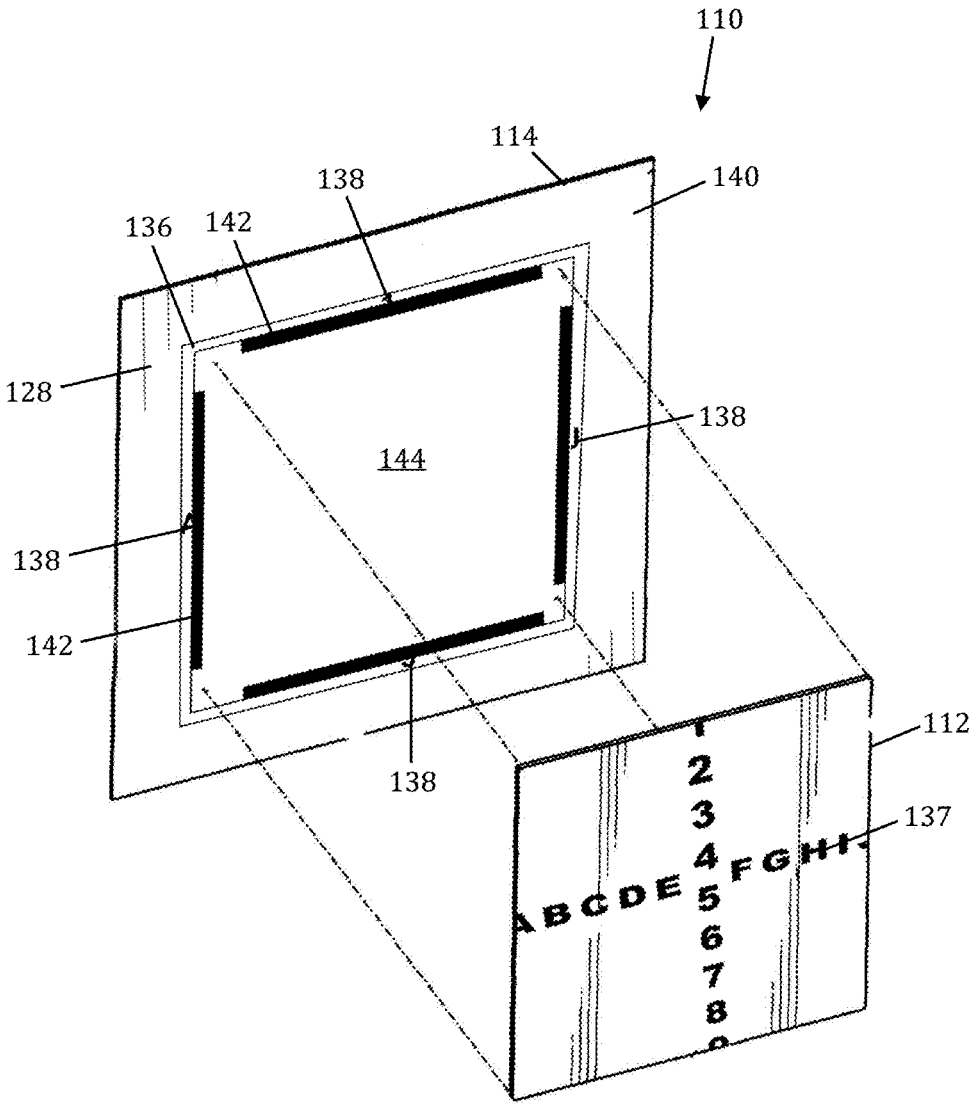
FIG. 11 is a perspective view of the post-printing metal plate and carrier of FIG. 10, particularly illustrating the metal plate being removed from the carrier and showing how the printer is "tricked" by the carrier into printing over the edges of the metal plate onto a portion of the carrier, thereby avoiding an unprinted margin or border on the metal plate.
Figure 12:
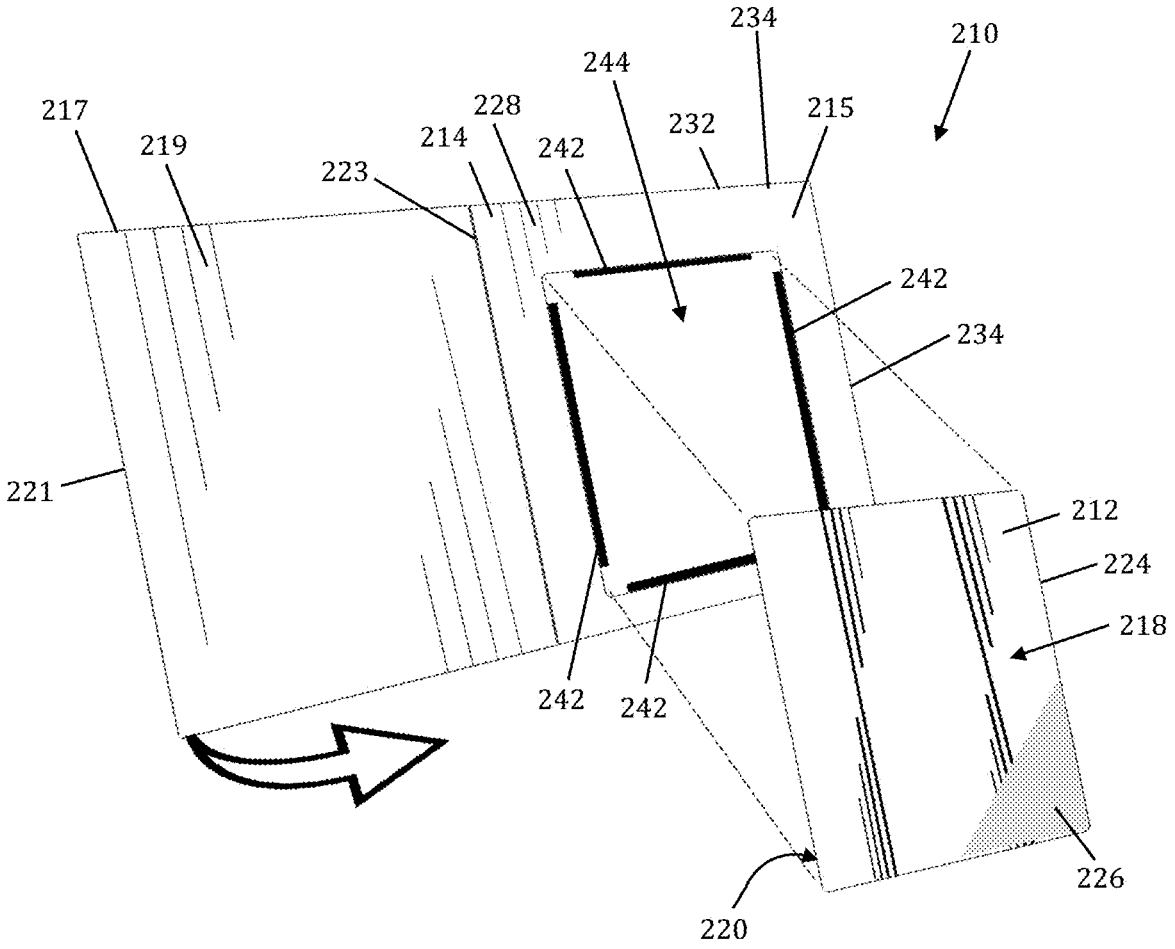
FIG. 12 is a perspective view of an example of a printable metal plate in alignment for association with an example of a metal plate carrier, according to another embodiment of the disclosure.

The front face 128 of the carrier 114 has an external coat that mimics the printable film layer 126 of the metal plate 112 such that the printer prints over the edges 124 of the metal plate 112 onto the carrier 114. This results in the metal plate 112 having printing 137 over its entire front face 118, and then leaving a narrow strip of overlap printing 138 in the print zone 136 of the carrier 114 that surrounds the edges 124 of the metal plate 112, while leaving an unprinted section 140 of the carrier 114 that was not printed upon, as shown in FIGS. 10-11.

Figure 6:
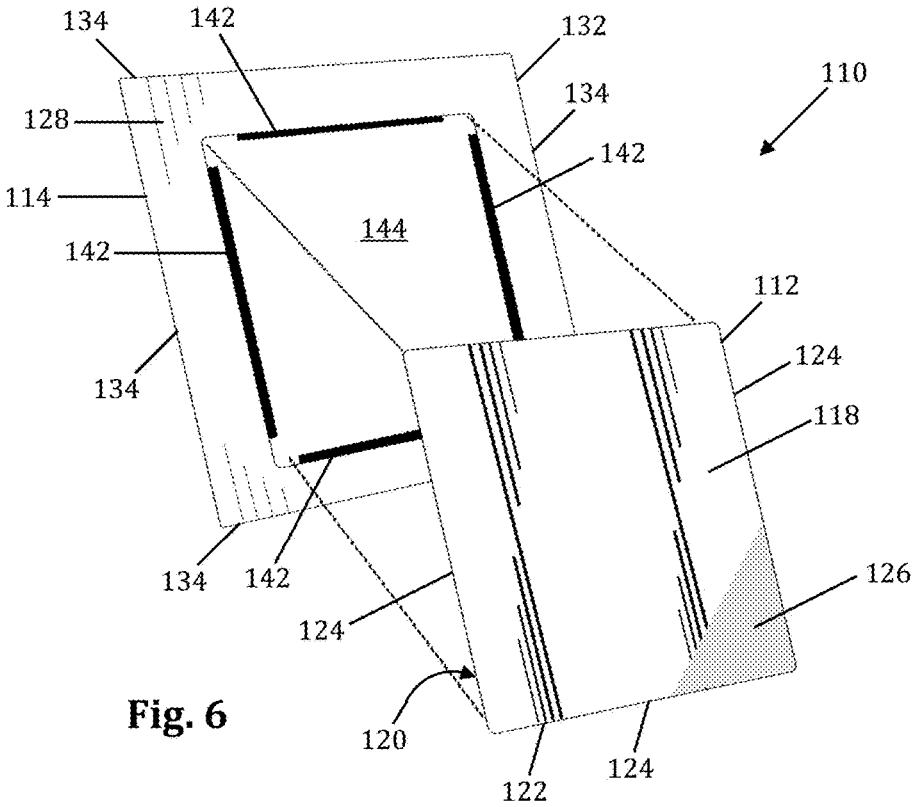
FIG. 6 is a perspective view of an example of a printable metal plate in alignment for association with an example of a metal plate carrier, according to another embodiment of the disclosure.
Figure 7:
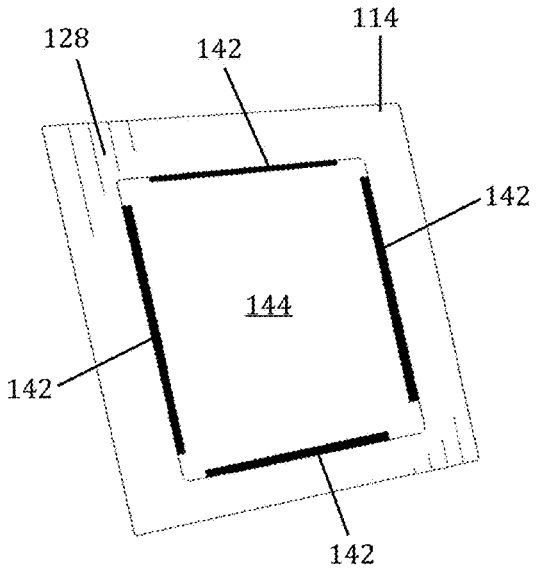
FIG. 7 is a perspective view of a front side of the carrier of FIG. 6.
Figure 8:
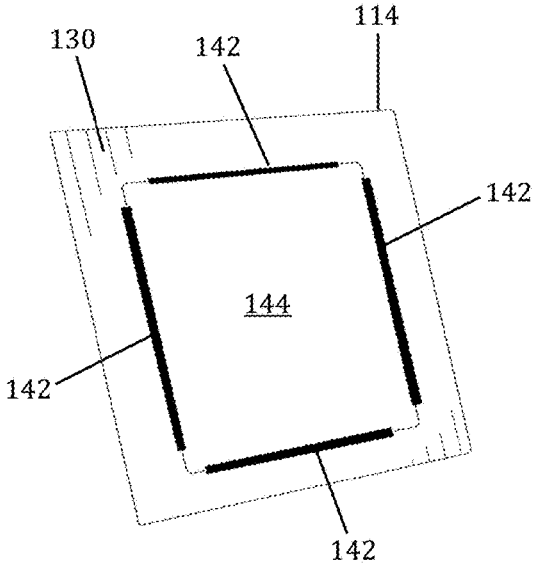
FIG. 8 is a perspective view of a back side of the carrier of FIG. 6.
Figure 9:
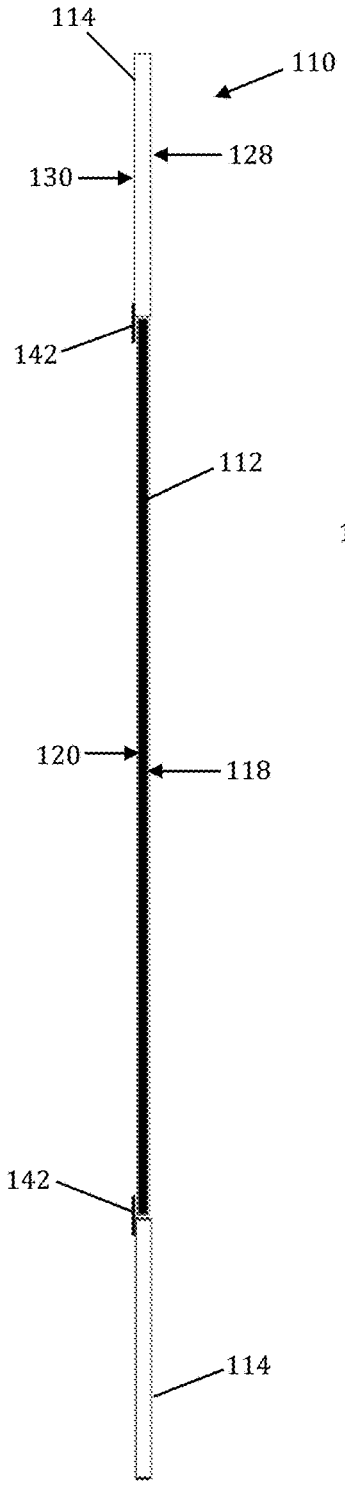
FIG. 9 is a side plan view of the printable metal plate of FIG. 6 associated with the carrier of FIG. 6.

The carrier 114 further includes at least one metal plate engaging element 142 configured to engage the metal plate 112 and maintain the association of the metal plate 112 and carrier 114 through the printing process. By way of example, the plate engaging element 142 of the instant embodiment comprises adhesive strips 142 that secure the metal plate 112 within a cutout opening 144 formed through the carrier 114 during the printing process, as shown in FIGS. 6 and 9. The adhesive strips 142 allow for removal of the metal plate 112 from the carrier 114 by exerting sufficient force on the metal plate 112 to overpower the adhesive strip. As shown in FIGS. 7-8, preferably the adhesive strips 142 are positioned such that a first portion of each adhesive strip is attached to the back face 130 of the carrier 114, and a second portion of each adhesive strip extends into the cutout opening 144 to enable engagement with the metal plate 112.

The cutout opening 144 is sized and configured to receive the entire perimeter 122 of the metal plate 112 thereby creating a recessed association between the metal plate 112 and carrier 114. By way of example, the cutout opening 144 is shown as having a generally rectangular (or square) perimeter shape, however any shape is possible that receives and securely engages the metal plate 112 during printing. In order to be able to receive the metal plate 112 therein, the perimeter of the cutout opening 144 must be larger than the perimeter 122 of the metal plate 112. Preferably, the distance between any part of the perimeter 122 of the metal plate 112 and the perimeter edge of the cutout opening 144 is within the range of 0.005-0.015". Gaps larger than 0.015" may cause the printer to detect the edge of the metal plate 112 and stop printing. Gaps smaller than 0.005" may cause the metal plate 112 to not fit within the cutout opening 144, especially in warm and/or humid climates.

The recessed association between the metal plate 112 and carrier 114 is advantageous in that it decreases the overall thickness of the plate/carrier combination, which in turn reduces the risk of metal plate 112 making contact with any of the internal components of the printer. Since most of the commercially available wide format aqueous inkjet printers that are compatible with the printing template 110 disclosed herein have a maximum allowable material thickness of approximately 1.5 mm, a recessed association between the plate 112 and carrier 114 enables a decrease in overall thickness of the printing template 110 and/or and increase in the thickness of the metal plate 112 to be printed on.

The hanging element (not shown) of the present embodiment is identical to the hanging element 16 described above, and may be attached to the back face 120 of the metal plate 112 through the cutout opening 144.

FIGS. 12-17 illustrate a third example of a printing template 210 for use in aqueous inkjet printing onto a metal substrate, according to one embodiment of the disclosure. By way of example only, the printing template 210 of the instant embodiment includes a printable metal plate 212, a carrier 214, and a hanging element (not shown). The printable metal plate 212 has front face 218, a back face 220, and a perimeter 222. In the example shown in FIGS. 12-17, the printable metal plate 212 has a generally rectangular shape having four opposing edges 224, however it should be understood that the metal plate 212 may have any shape (e.g. circular, oval, triangular, etc.) without departing from the scope of the disclosure. Preferably, the metal plate 212 is made of aluminum, however other any other suitable metal may be used.

The front face 218 is completely covered by a printable film layer 226, and defines the printable surface of the metal plate 212. The printable film layer 226 may be any material that is capable of accepting aqueous inkjet ink, including but not limited to (and by way of example only) polyester, polyethylene, Mylar, vinyl, PVC, PET, BOTT, polypropylene, polycorbonate, and acrylics. The key to the selection of the film is that it can accept and retain the aqueous ink from an inkjet printer. According to a preferred embodiment, an inkjet ink-retaining microporous coating may be applied on top of the printable film layer 226 to enhance the ink retention properties of the printable film layer 226. The coating technique can be accomplished (by way of example) with slot die, curtain, gravure or Mayer rod techniques. It should be noted, however, that the key characteristics of the printable film layer 226 include, but are not limited to, ink adhesion and retention properties, cost, and optical clarity. With the use of this specialized printable film 226, there is no need for any "final" covering sheet or other process to seal in the ink after the metal print leaves the printer.

The carrier 214 comprises a plate-holding portion 215 and a plate-protecting element 217. By way of example, the plate-holding portion 215 is similar to the carrier 114 described above, and has front face 228, a back face 230, and a perimeter 232. The carrier 214 is sized and configured such that plate-holding portion 215 is larger than the metal plate 212, and more specifically such that the entire perimeter 232 of the plate-holding portion 215 is outside of the entire perimeter 222 of the metal plate 212 when the metal plate 212 is associated with the carrier 214. The respective perimeter shapes of the metal plate 212 and plate-holding portion 215 do not have to match. In the example shown in FIGS. 12-17, the plate-holding portion 215 has a generally rectangular shape having four opposing edges 234. Although the generally rectangular shape is preferable since the carrier 214 interacts with the printer and therefore consistency of size and shape is advantageous, nevertheless it should be understood that the plate-holding portion 215 may have any perimeter shape (e.g. circular, oval, triangular, etc.) without departing from the scope of the disclosure, so long as the entire perimeter 232 of the plate-holding portion 215 is outside of the entire perimeter 222 of the metal plate 212. That is because a portion of the front face 228 (e.g. the portion of the front face 228 that is immediately adjacent the perimeter 222 of the metal plate 212) represents a "print zone" 236 that receives ink from the ink dispensing element of the printer when the ink dispensing element traverses beyond the perimeter 222 of the metal plate 112 during the printing process (see e.g. FIG. 16).

Figure 16:
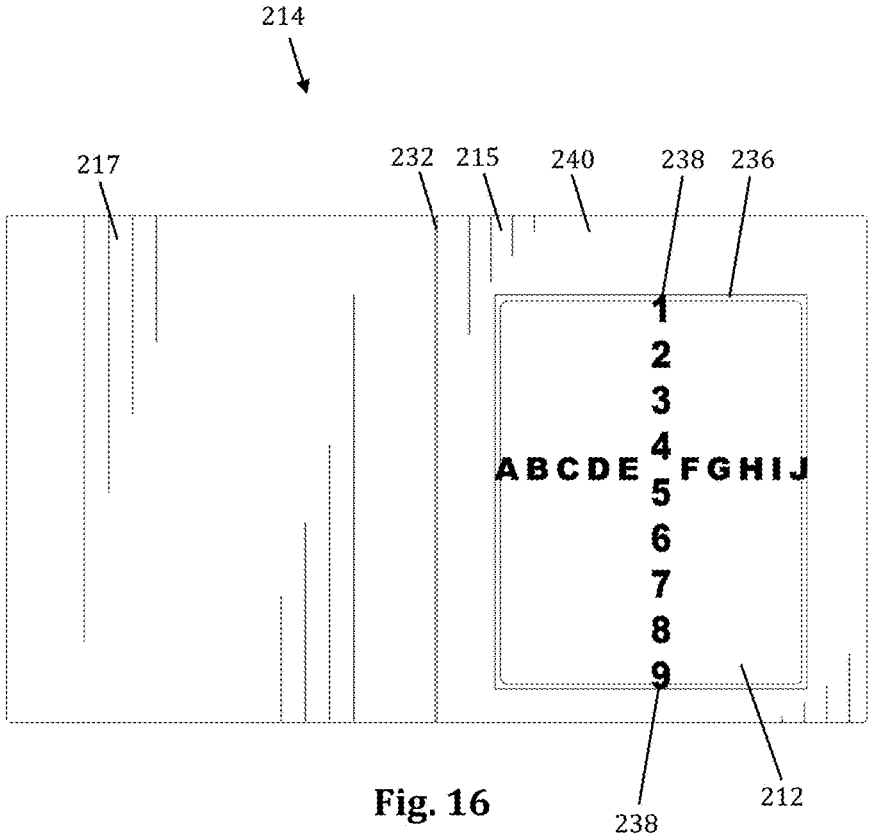
FIG. 16 is a plan view of the metal plate and carrier of FIG. 15 after printing has occurred.
Figure 17:
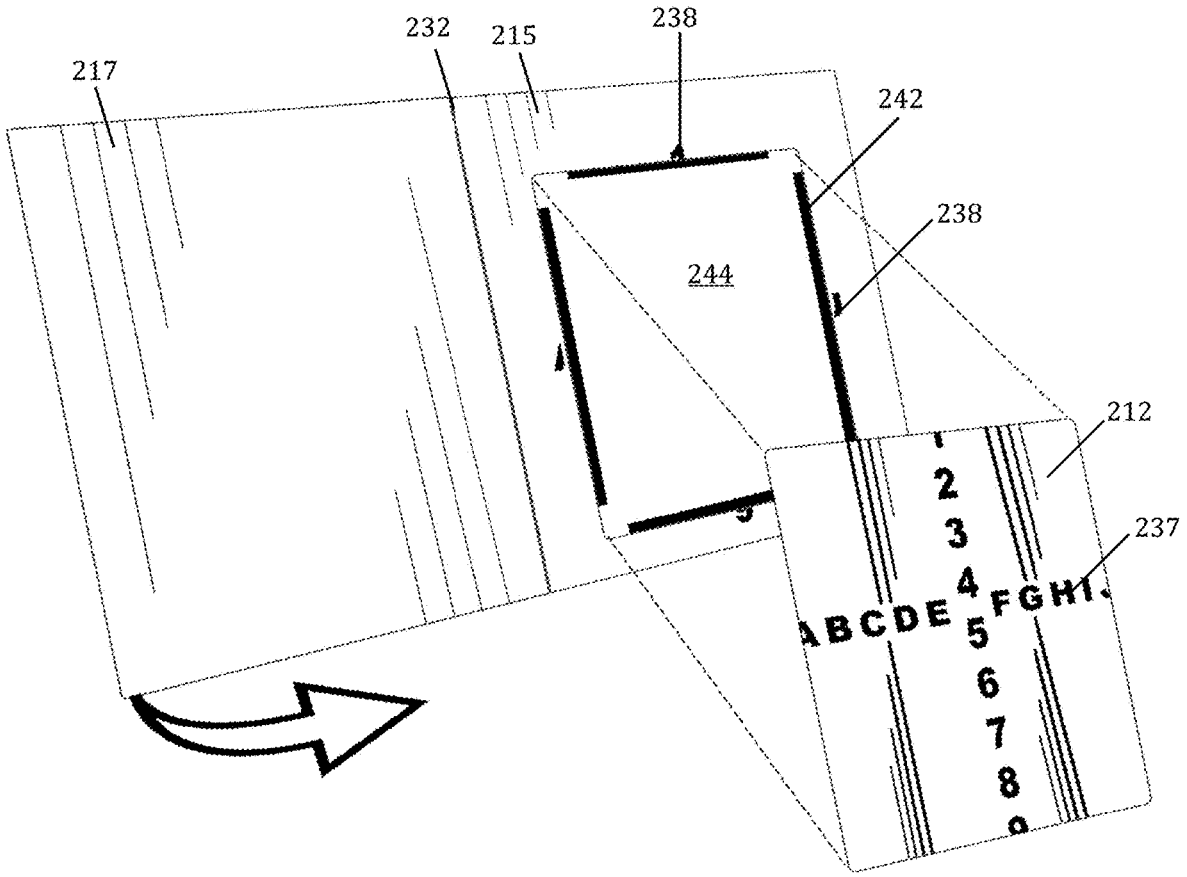
FIG. 17 is a perspective view of the post-printing metal plate and carrier of FIG. 16, particularly illustrating the metal plate being removed from the carrier and showing how the printer is "tricked" by the carrier into printing over the edges of the metal plate onto a portion of the carrier, thereby avoiding an unprinted margin or border on the metal plate.

The front face 228 of the plate-holding portion 215 has an external coat that mimics the printable film layer 226 of the metal plate 212 such that the printer prints over the edges 224 of the metal plate 212 onto the carrier 214. This results in the metal plate 212 having printing 237 over its entire front face 218, and then leaving a narrow strip of overlap printing 238 in the print zone 236 of the plate-holding portion 215 that surrounds the edges 224 of the metal plate 212, while leaving an unprinted section 240 of the carrier 214 that was not printed upon, as shown in FIGS. 16-17.

Figure 13:
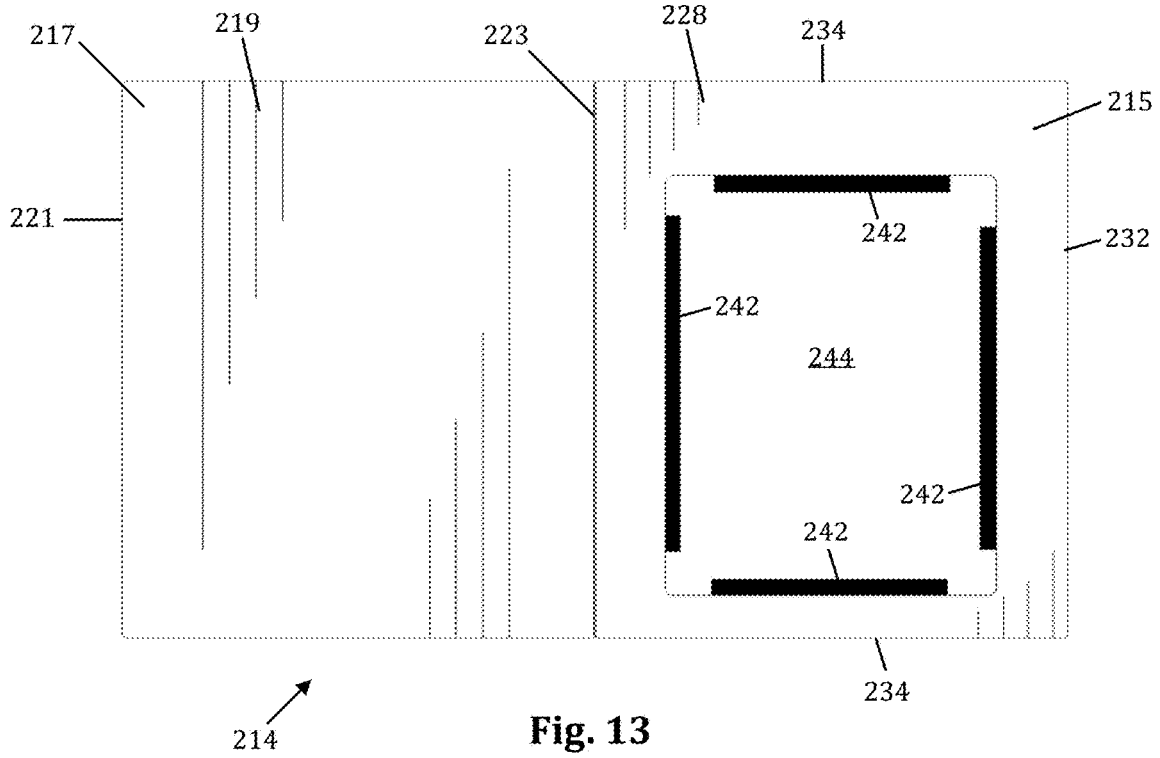
FIG. 13 is a perspective view of a front side of the carrier of FIG. 12.
Figure 14:
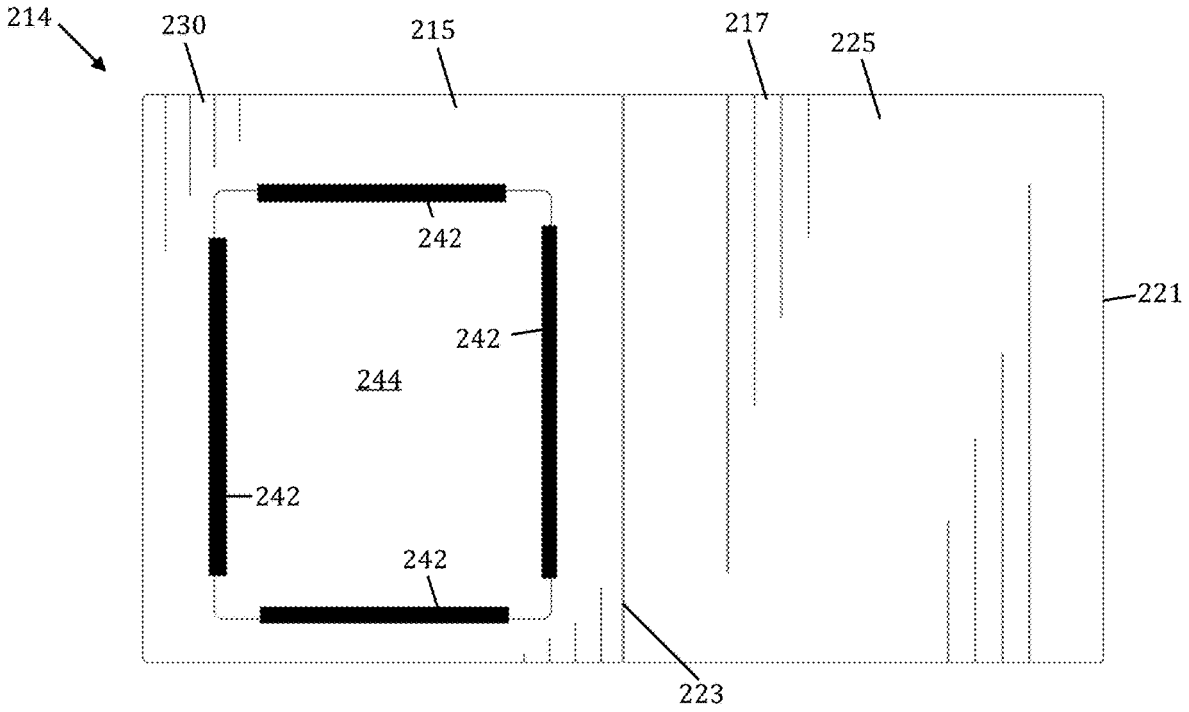
FIG. 14 is a perspective view of a back side of the carrier of FIG. 12.
Figure 15:
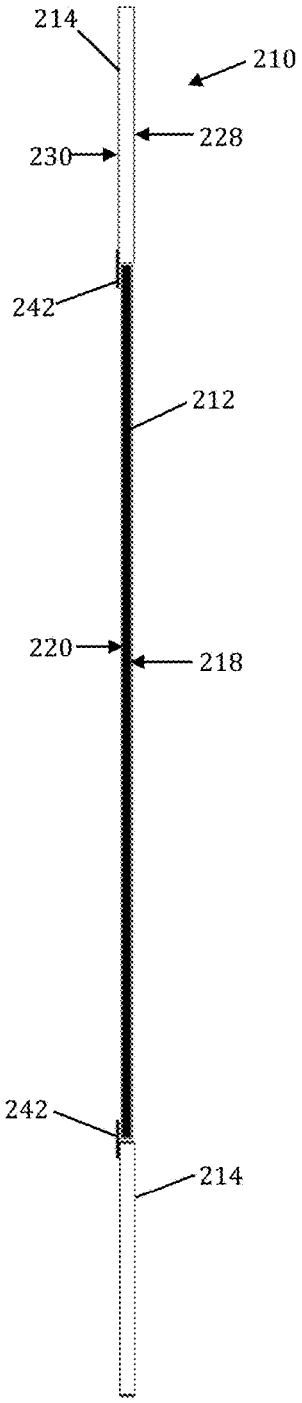
FIG. 15 is a side plan view of the printable metal plate of FIG. 12 associated with the carrier of FIG. 6.

The plate-holding portion 215 of the carrier 214 further includes at least one metal plate engaging element 242 configured to engage the metal plate 212 and maintain the association of the metal plate 212 and carrier 214 through the printing process. By way of example, the plate engaging element 242 of the instant embodiment comprises adhesive strips 242 that secure the metal plate 212 within a cutout opening 244 formed through the plate-holding portion 215 during the printing process, as shown in FIGS. 12-15. The adhesive strips 242 allow for removal of the metal plate 212 from the carrier 214 by exerting sufficient force on the metal plate 212 to overpower the adhesive strips. As shown in FIGS. 13-14, preferably the adhesive strips 242 are positioned such that a first portion of each adhesive strip is attached to the back face 230 of the plate-holding portion 215, and a second portion of each adhesive strip extends into the cutout opening 244 to enable engagement with the metal plate 212.

The cutout opening 244 is sized and configured to receive the entire perimeter 222 of the metal plate 212 thereby creating a recessed association between the metal plate 212 and carrier 214. By way of example, the cutout opening 244 is shown as having a generally rectangular (or square) perimeter shape, however any shape is possible that receives and securely engages the metal plate 212 during printing. In order to be able to receive the metal plate 212 therein, the perimeter of the cutout opening 244 must be larger than the perimeter 222 of the metal plate 212. Preferably, the distance between any part of the perimeter 222 of the metal plate 212 and the perimeter edge of the cutout opening 244 is within the range of 0.005-0.015". Gaps larger than 0.015" may cause the printer to detect the edge of the metal plate 212 and stop printing. Gaps smaller than 0.005" may cause the metal plate 212 to not fit within the cutout opening 244, especially in warm and/or humid climates.

The recessed association between the metal plate 212 and carrier 214 is advantageous in that it decreases the overall thickness of the plate/carrier combination, which in turn reduces the risk of metal plate 212 making contact with any of the internal components of the printer. Since most of the commercially available wide format aqueous inkjet printers that are compatible with the printing template 210 disclosed herein have a maximum allowable material thickness of approximately 1.5 mm, a recessed association between the plate 212 and carrier 214 enables a decrease in overall thickness of the printing template 210 and/or and increase in the thickness of the metal plate 212 to be printed on.

The plate-protecting portion 217 may be any feature or element that protects the printable surface 218 (including the printable film 226) of the metal plate 212 before and/or after the printing process has been completed. By way of example only, the plate-protecting portion 217 of the present embodiment comprises a foldable flange 217 extending from one edge 234 of the plate-holding portion 215. The flange 217 includes a front face 219, a back face 225, and a perimeter edge 221. Because the flange 217 does not receive any ink during the printing process, the front face 219 does not need to be coated with the same external coat (mimicking the printable film layer 226) used on the plate-holding portion 215. The perimeter edge 221 is sized and configured such that the plate-protecting portion 217 is large enough to cover the metal plate 212 within the cutout opening 244, and preferably is the same size and shape as the perimeter 232 of the plate-holding portion 215. The plate-protecting portion 217 is joined to the plate-holding portion at an interface 223, that allows the plate-protecting portion 217 to fold (or pivot) over the plate-holding portion 215 such that the front face 219 of the plate-protecting portion 217 contacts the front face 218 of the plate-holding portion 215. By way of example, the interface 223 may be any feature or element that enables this folding, including but not limited to a hinge, groove, adhesive, etc.). In any event, the plate-protecting portion 217 is in an "open" or "unfolded" configuration during the printing process, in which the plate-protecting portion 217 is located to the side of and is generally coplanar with the plate-holding portion 215 to enable seamless passage of the carrier 214 through the printer.

The hanging element (not shown) of the present embodiment is identical to the hanging element 16 described above, and may be attached to the back face 220 of the metal plate 212 through the cutout opening 244.

Figure 18:
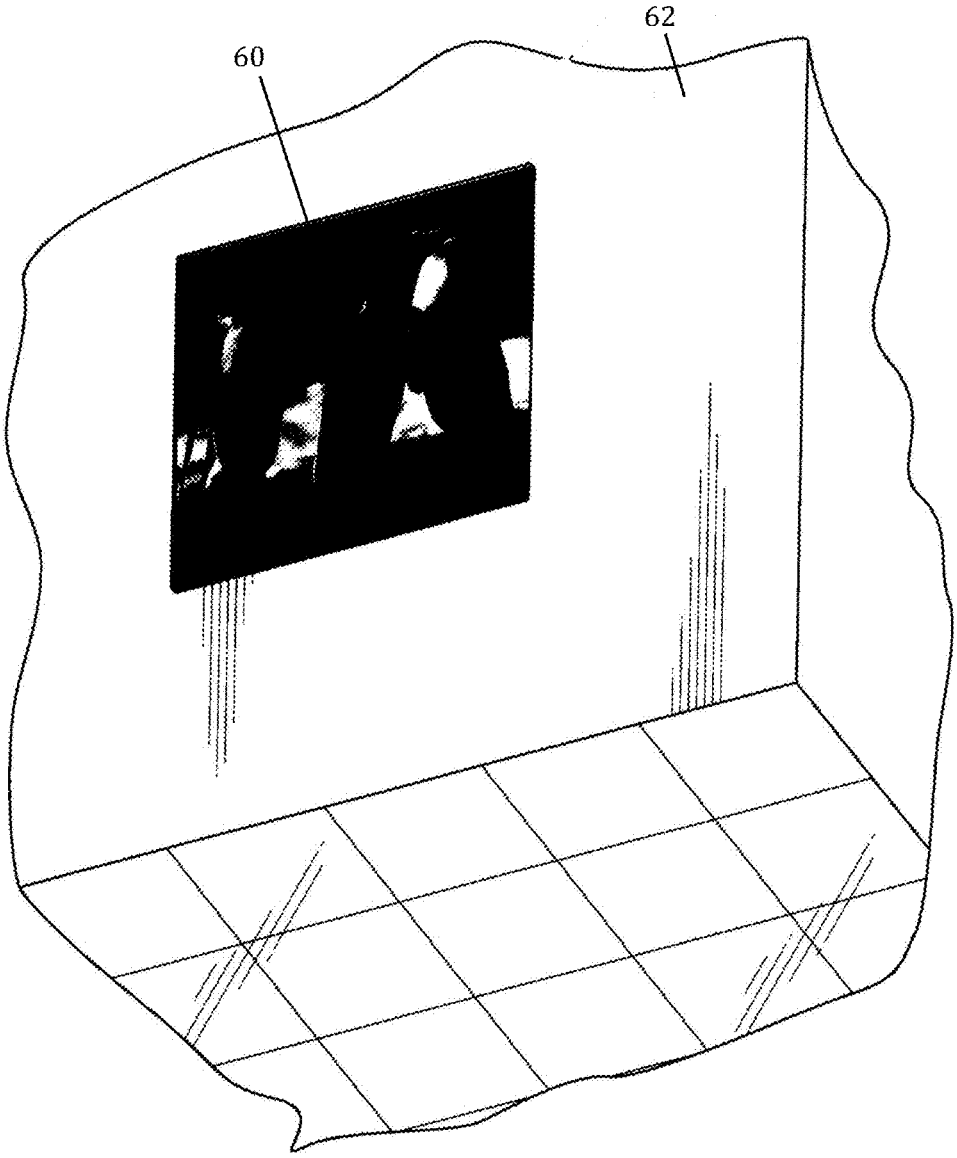
FIG. 18 is a perspective view of a finished picture printed on a printable metal plate hanging on a wall, according to one embodiment of the disclosure.

FIG. 18 illustrates an example of a finished picture 60 on a wall 62. Because the printing has been done such that the printer head prints over the edges of the metal plate 12/112/212, the resulting picture 60 is borderless.

Figure 19:
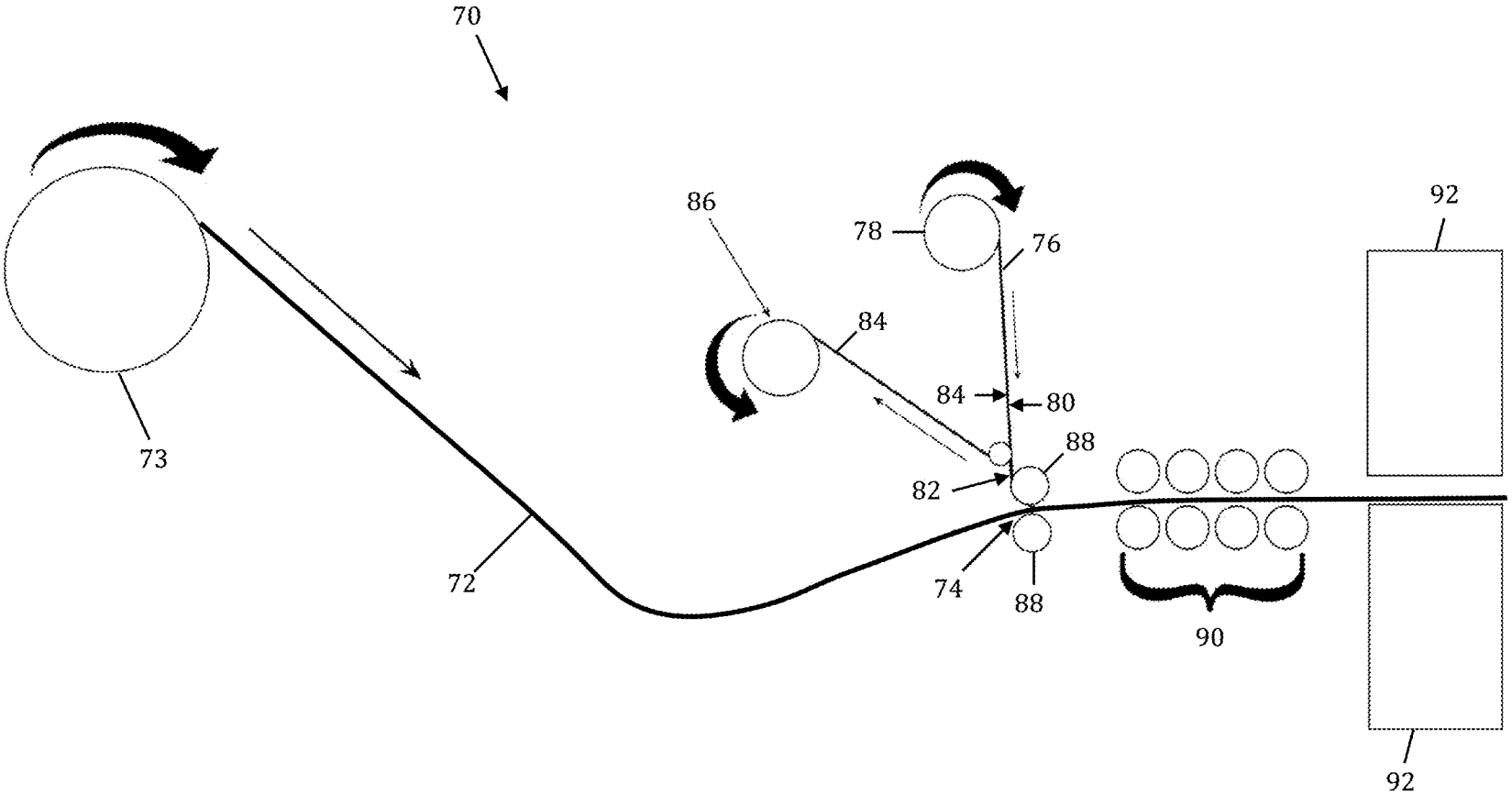
FIG. 19 is a schematic drawing of the process of preparing the printable metal plates for printing, according to one embodiment of the disclosure.

FIG. 19 is a schematic drawing showing an example process 70 by which the metal plates 12/112/212 are prepared according to one embodiment of the disclosure. By way of example, the process 70 begins with a sheet of metal 72 (e.g. aluminum) that is unrolled from a coil 73 and directed to a nip point 74 that crimps a layer of printable film 76 (e.g. the printable film layer 26/126/226 described above) to one surface of the metal sheet 72. The printable film layer 76 originates from a liner roll 78, and has a printable side 80 and an adhesive side 82, which is initially covered with an adhesive cover 84. Prior to crimping with the metal sheet 72, the adhesive cover 84 is removed from the adhesive side 82 and taken in by a release liner uptake coil 86. With the adhesive cover 84 removed, the adhesive side 82 is brought into contact with the metal sheet 72 at the nip point 74 (e.g. between a pair of nip rollers 88) so that the printable film layer 76 can adhere to the metal sheet 72. After the printable film layer 76 and metal sheet 72 are adhered to one another at the nip point 74, the metal sheet 72 passes through a metal flattening machine 90 (e.g. comprising a plurality of roller elements that apply compressive force to the metal sheet 72 with printable film layer 76 to ensure adhesion and also remove potential air bubbles caught between the printable film layer 76 and metal sheet 72. Finally, the individual metal plates 12/112/212 may be stamped out of the metal sheet 72 in a stamping press 92. Once this occurs, the metal plates 12/112/212 are ready to use with the carriers 14/114/214 as described above. With the use of this specialized printable film 76, there is no need for any "final" covering sheet or other process to seal in the ink after the metal plates go through printing process.

Figure 20:
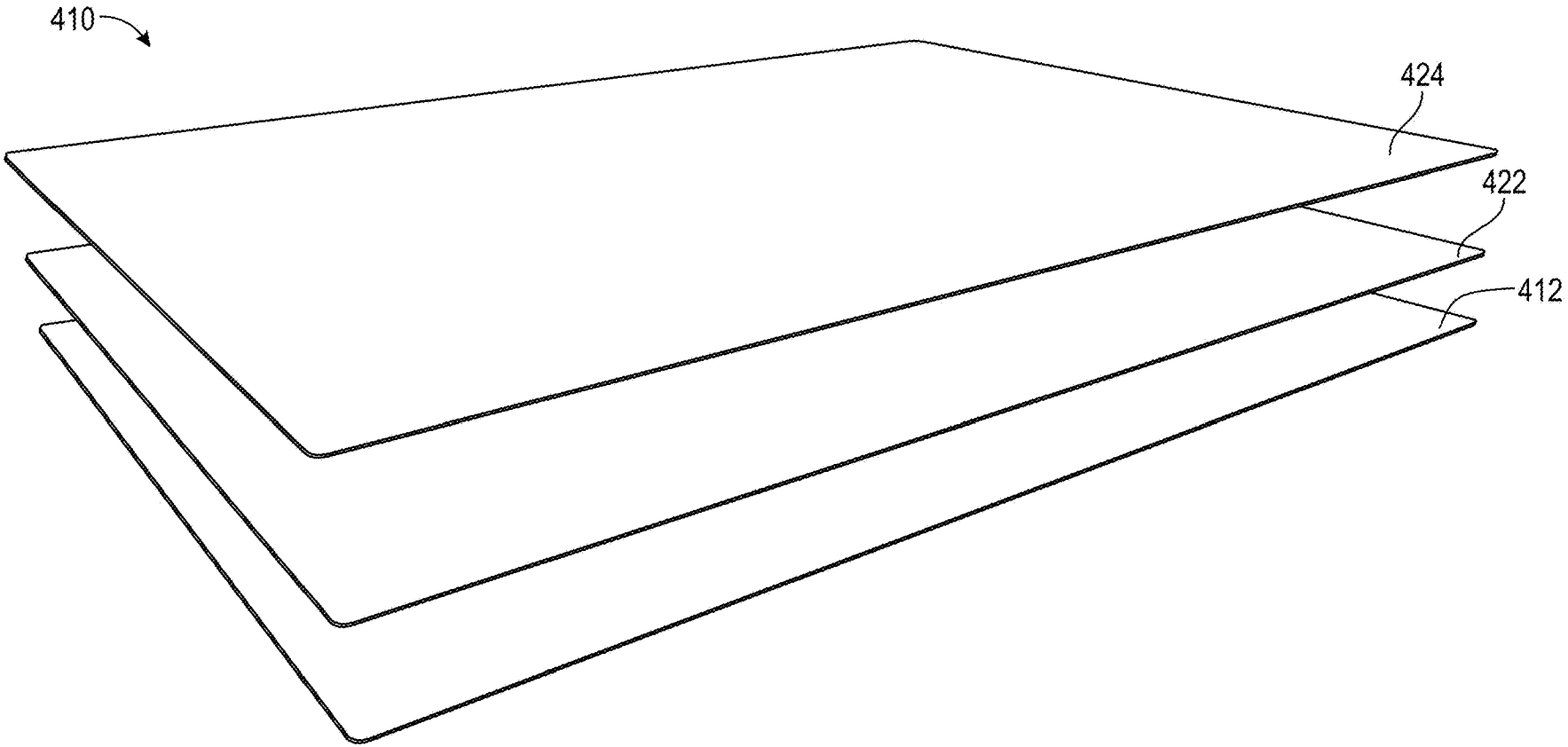
FIG. 20 is a perspective view of an example of a metal panel, according to yet another embodiment of the disclosure.
Figure 21:
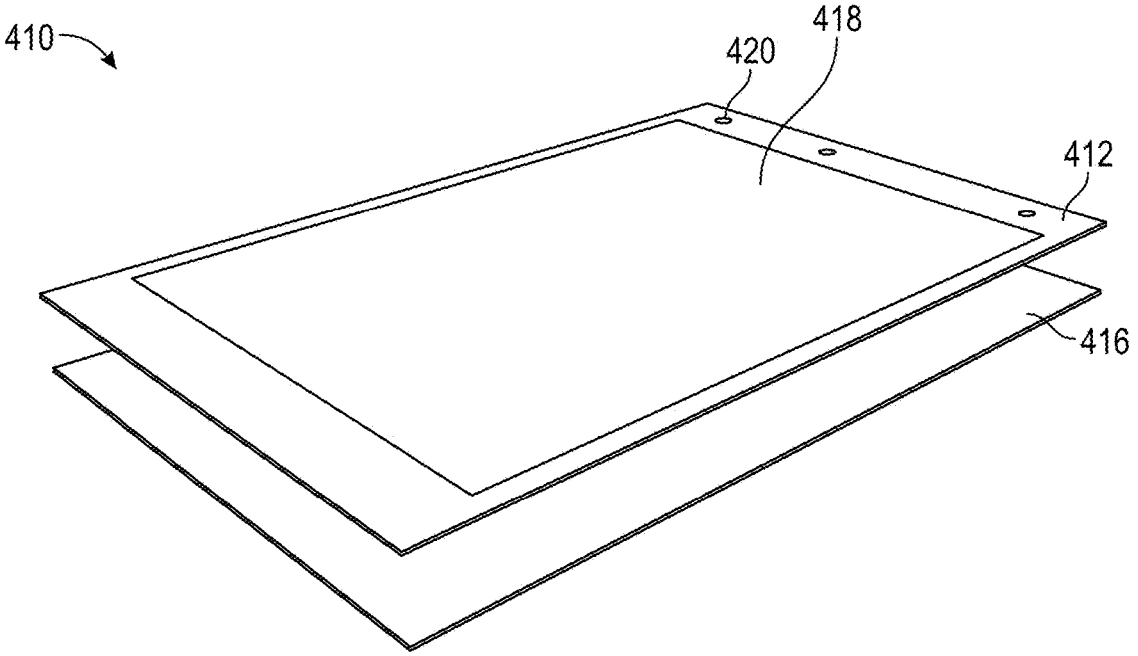
FIG. 21 is a perspective view of an example of a printable film and a carried, according to yet another embodiment of the disclosure.
Figure 22:
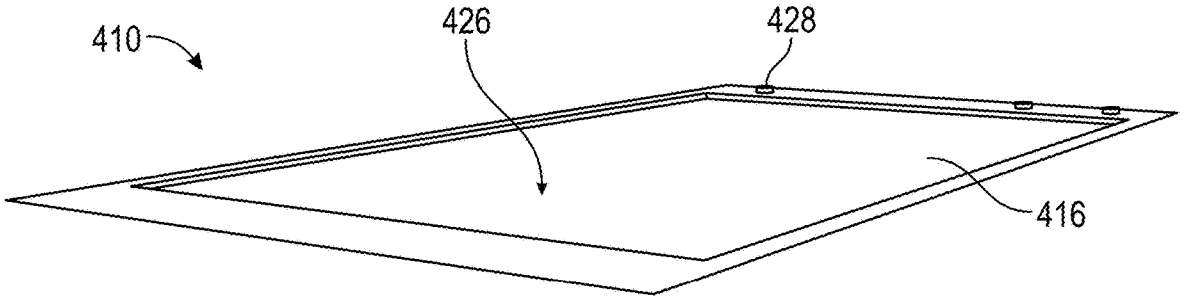
FIG. 22 is a perspective view of an example of a carrier or alignment jig, according to yet another embodiment of the disclosure.

FIGS. 20-22 illustrate a fourth example of a printing template 410 for use in printing onto a metal panel, according to one embodiment of the disclosure. By way of example only, the printing template 410 of the instant embodiment includes a printable film 412, a metal panel 414, a carrier 416, and a hanging element (not shown).

The printable film 412 is having a first layer and a second layer opposite the first layer. The first layer defines a printable surface and has a die cut area 418 inside perimeter edge of the first layer. The printable film 412 may be any material that is capable of accepting aqueous inkjet ink, including but not limited to (and by way of example only) polyester, polyethylene, Mylar, vinyl, PVC, PET, BOTT, polypropylene, polycorbonate, and acrylics. The key to the selection of the printable film 412 is that it can accept and retain the aqueous ink from an inkjet printer. According to a preferred embodiment, an inkjet ink-retaining microporous coating may be applied on top of the printable film 412 to enhance the ink retention properties of the printable film 412. The coating technique can be accomplished (by way of example) with slot die, curtain, gravure or Mayer rod techniques. It should be noted, however, that the key characteristics of the printable film 412 include, but are not limited to, ink adhesion and retention properties, cost, and optical clarity. With the use of this specialized printable film 412, there is no need for any "final" covering sheet or other process to seal in the ink after the metal print leaves the printer.

In an example, the first layer of the printable film 412 is a clear film with an ink receptive coating, while the second layer of the printable film is a white film or paper with a removable or repositionable adhesive.

In an example, the printable film 412 includes a plurality of alignment holes 420 formed therein. The alignment holes 420 extend through top portions, near top edges, of the first and second layers of the printable film 412

Further, the metal panel 414 includes a first layer, a second layer opposite the first layer, and a shaped perimeter having the same size as to that of the die cut area 418 in the printable film 412.

The first layer of the metal panel 414 is coated with an adhesive 422 to receive image from the printable film 412 during lamination process. In one example, the adhesive of the metal panel 414 is one of a thermally activated adhesive and a pressure sensitive adhesive. In an example, the adhesive of the metal panel 414 may be covered with a protective film 424. This protective film 424, if provided, has to be removed after placement of the metal panel 414 inside a recess of the carrier 416 (alignment jig).

In the example shown in FIGS. 20-22, the metal panel 414 has a generally flat rectangular shape having four opposing edges, however it should be understood that the metal panel 414 may have any shape (e.g. circular, oval, triangular, etc.) without departing from the scope of the disclosure. Preferably, the second layer of the metal panel 414 is made from one of aluminum, tinplate, steel, or their combinations, however other any other suitable metal may be used.

Yet further, the carrier 416 includes a first side and a second side opposite the first side. The first side of the carrier 416 includes a recess 426 which is sized and configured to encompass the shaped perimeter of the metal panel 414. The first side of the carrier 416 includes a plurality of raised alignment pins 428 to register with corresponding alignment holes 420 of the printable film 412 so as to securely engage carrier 416 with the printable film 412. Also, on the first side, the carrier 416 has a non-stick coating around the recess 426 to prevent printing to the surface of the carrier 416 during printing of the metal panel 414.

In operation of the fourth embodiment, firstly, the printable film 412 is inserted into an inkjet printer so as to print an image on a printable surface of the printable film 412. The printable surface is defined within a die cut area 418 of a first side of the printable film 412. The die cut area 418 allows a printed image to fill the printable surface in the die cut area 418 and extends on to at least a portion (beyond the die cut area 418) of the first side of the printable film 412.

Then, the metal panel 414 is placed inside the recess 426 of the carrier (alignment jig) 416, with a side having the adhesive 422 away from the base of the recess 426. The carrier 416 on a side, away from the recess 426, also has a square or rectangular shape pre-cut so that it can be easily removed, for example, such that a hanger can be attached to the metal panel 414 through the carrier 416.

Thereafter, the printable film 412 is placed, image printed side down on the carrier (alignment jig) 416 over the top of the adhesive side of the metal panel 414. That is, the printed side of the printable film 412 faces the adhesive side of the metal panel 414, while sandwiching the metal panel 414 in between the printable film 412 and the carrier 416. During sandwiching, the metal panel 414 is fixedly positioned in the die cut area 418 of the printable film 412 and the recess 426 of the carrier 416.

Also, the alignment holes 420 of the printable film 412 are sized and configured to allow passage of the corresponding alignment pins 428 of the carrier 416 therethrough, so as to sandwich the metal panel 414 between the printable film 412 and the carrier 416. Also, in an example, these alignment pins 428 may not be evenly spaced so that there is only one way that the printable film 412 will match the alignment pins 428.

This "sandwich" is then fed through heated rollers of a lamination device to activate the thermal adhesive 422 coated on the metal panel 414, thereby bonding the printable film 412 to the surface of the metal panel 414. After this lamination process of the lamination device, the excess printable film 412 is removed and discarded, leaving a printed image on the metal panel 414. This printed image is protected by the printable film 412, as that printable film 412 now acts as a protective laminate.

Also, in an example, the carrier 416 may include a non-stick coating around the recess (holding the metal panel) 426 to prevent printing to the surface of the carrier 416 during transportation printing of the image to the metal panel 414.

It should be understood that while preferred embodiments are described in some detail herein, the present disclosure is made by way of example only and that variations and changes thereto are possible without departing from the subject matter coming within the scope of the following claims, and a reasonable equivalency thereof.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

What is claimed is:

1. A printing template for use during an aqueous inkjet printing process in which ink is transferred onto a metal panel, consisting of:

a printable film having a first layer, a second layer opposite the first layer, and a die cut area inside a perimeter edge of the first layer, the first layer defining a printable surface;

a generally flat metal panel having a first layer, a second layer opposite the first layer, and a shaped perimeter having a same size as to that of the die cut area in the printable film, the first layer includes an adhesive to receive an image from the printable film; and a carrier having a first side and a second side opposite the first side, the first side including a recess which is sized and configured to encompass the shaped perimeter of the metal panel;

wherein the metal panel is securely associated in between the printable film and the carrier during the printing process, and is thereafter removable from the printable film and the carrier after completion of the printing process, wherein the first layer of the printable film is a clear film with an ink receptive coating, wherein the second layer of the printable film is a white film or paper with a removable or repositionable adhesive.

2. The printing template of claim 1, wherein the printable film includes a plurality of alignment holes formed therein, the alignment holes extending through the first and second layers of the printable film, wherein the first side of the carrier includes a plurality of raised alignment pins to register with corresponding alignment holes of the printable film so as to securely engage the printable film, wherein the alignment holes of the printable film are sized and configured to allow passage of the corresponding alignment pins of the carrier therethrough, so as to sandwich the metal panel between the printable film and the carrier, wherein the adhesive of the metal panel is one of a thermally activated adhesive and a pressure sensitive adhesive.

3. The printing template of claim 1, wherein the printable film comprises at least one of polyester, polyethylene, Mylar, vinyl, PVC, PET, BOTT, polypropylene, polycarbonate, and acrylic.

4. The printing template of claim 1, wherein the adhesive of the metal panel is one of a thermally activated adhesive and a pressure sensitive adhesive.

5. The printing template of claim 1, wherein the second layer of the metal panel is a metal plate is made from one of aluminum, tinplate, steel, or their combinations.

6. The printing template of claim 1, wherein the carrier has a non-stick coating around the recess to prevent printing to the surface of the carrier during printing of the printing template.

7. A printing template for use during an aqueous inkjet printing process in which ink is transferred onto a metal panel, comprising:

a printable film having a first layer, a second layer opposite the first layer, and a die cut area inside perimeter edge of the first layer, the first layer defining a printable surface;

a generally flat metal panel having a first layer, a second layer opposite the first layer, and a shaped perimeter having a same size as to that of the die cut area in the printable film, the first layer includes an adhesive to receive an image from the printable film; and a carrier having a first side and a second side opposite the first side, the first side including a recess which is sized and configured to encompass the shaped perimeter of the metal panel;

wherein the metal panel is securely associated in between the printable film and the carrier during the printing process, and is thereafter removable from the printable film and the carrier after completion of the printing process.

8. The printing template of claim 7, wherein the first layer of the printable film is a clear film with an ink receptive coating.

9. The printing template of claim 8, wherein the first side of the carrier includes a plurality of raised alignment pins to register with corresponding alignment holes of the printable film so as to securely engage the printable film.

10. The printing template of claim 7, wherein the second layer of the printable film is a white film or paper with a removable or repositionable adhesive.

11. The printing template of claim 10, wherein the alignment holes of the printable film are sized and configured to allow passage of the corresponding alignment pins of the carrier therethrough, so as to sandwich the metal panel between the printable film and the carrier.

12. The printing template of claim 7, wherein the printable film includes a plurality of alignment holes formed therein, the alignment holes extending through the first and second layers of the printable film.

13. A method of printing on a metal panel, comprising the steps of:

inserting a printable film into an inkjet printer, the printable film having a first layer, a second layer opposite the first layer, and a die cut area inside a perimeter edge of the first layer, the first layer defining a printable surface;

printing on the printable film such that a printed image fills the entirety of the printable surface in the die cut area and extends on to at least a portion of the first layer of the printable film;

providing a generally flat metal panel having a first layer, a second layer opposite the first layer, and a shaped perimeter, the first side having a same size as to that of the die out area in the printable film, the first layer including an adhesive to receive an image from the printable film;

providing a carrier having a first side and a second side opposite the first side, the first side including a recess which is sized and configured to encompass the shaped perimeter of the metal panel;

securely associating the metal panel in between the printable film and the carrier to form a printing template, wherein the first layer of the metal panel is facing the same direction as the first layer of the printable film;

inserting the printing template into a laminator;

transforming the printed image from the first layer of the printable film to the first layer of the metal panel by activating the adhesive of the first layer of the metal panel during lamination such that the printed image fills the entirety of the first layer of the metal panel and extends on to at least a portion of the carrier; and removing the metal panel from the printable film and the carrier.

14. The method of claim 13, wherein the first layer of the printable film is a clear film with an ink receptive coating.

15. The method of claim 14, wherein the first side of the carrier includes a plurality of raised alignment pins to register with corresponding alignment holes of the printable film so as to securely engage the printable film.

16. The method of claim 13, wherein the second layer of the printable film is a white film or paper with a removable or repositionable adhesive.

17. The method of claim 16, wherein the step of securely associating the metal panel in between the printable film and the carrier includes engaging the alignment pins of the alignment pins through the alignment holes of the printable film to sandwich the metal panel between the printable film and the carrier.

18. The method of claim 13, wherein the printable film includes a plurality of registration alignment holes formed therein, the alignment holes extending through the first and second layers of the printable film.

19. The method of claim 13, wherein the printable film comprises at least one of polyester, polyethylene, Mylar, vinyl, PVC, PET, BOTT, polypropylene, polycarbonate, and acrylic.

20. The method of claim 13, wherein the adhesive of the metal panel is one of a thermally activated adhesive and a pressure sensitive adhesive, and wherein the second layer of the metal panel is a metal plate is made from one of aluminum, tinplate, steel, or their combinations.

* * * * *